United States Patent [19]

Ohtsu

[11] Patent Number: 4,661,798

[45] Date of Patent: Apr. 28, 1987

[54] VIDEO FIELD DECODER

[75] Inventor: Kiyonao Ohtsu, Kawasaki, Japan

[73] Assignee: Motorola, Inc., Schaumburg, Ill.

[21] Appl. No.: 687,413

[22] Filed: Dec. 28, 1984

[51] Int. Cl.[4] ..... G09G 1/14

[52] U.S. Cl. ..... 340/744; 340/721; 358/152

[58] Field of Search ..... 340/744, 721, 745, 814; 358/152, 183

[56] References Cited

U.S. PATENT DOCUMENTS

| | | | |
|---|---|---|---|
| 4,286,264 | 8/1981 | Matherat | 340/744 |
| 4,297,693 | 10/1981 | Parsons | 340/744 |
| 4,360,805 | 11/1982 | Andrews et al. | 340/744 |
| 4,425,581 | 1/1984 | Schweppe et al. | 340/721 |
| 4,437,167 | 3/1984 | Demke et al. | 340/744 |
| 4,450,442 | 5/1984 | Tanaka | 340/721 |
| 4,549,611 | 7/1986 | Bowker et al. | 340/721 |

*Primary Examiner*—Gerald L. Brigance
*Attorney, Agent, or Firm*—Dale E. Jepsen

[57] ABSTRACT

A video field decoder is provided in a raster scan interlaced video display system, which decoder provides an indication of whether the odd or even field is currently being displayed. The decoder circuit compares the horizontal and vertical sync signals and provides an output on their coincidence, indicating a given field level (odd or even) is being displayed.

2 Claims, 2 Drawing Figures

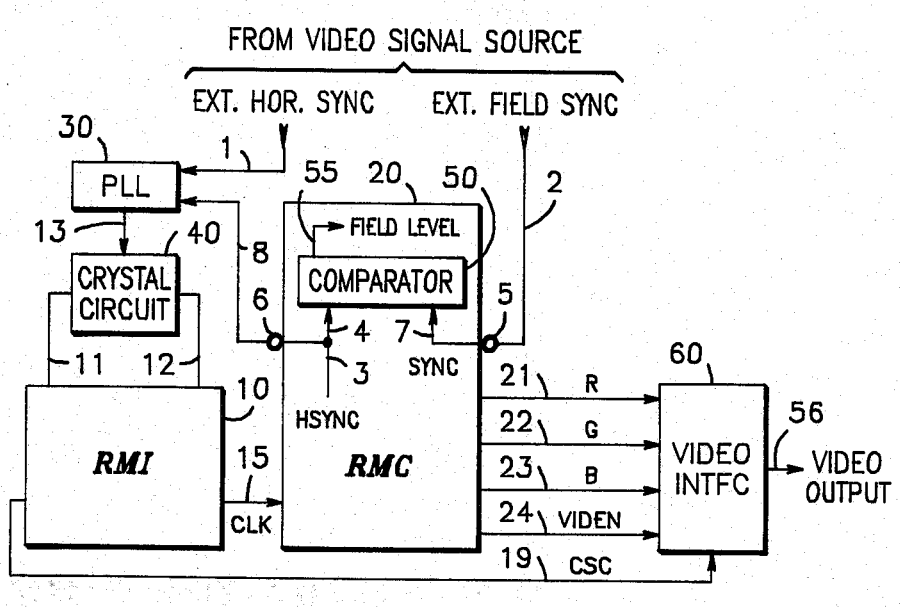
FIG. 1
FIG. 2
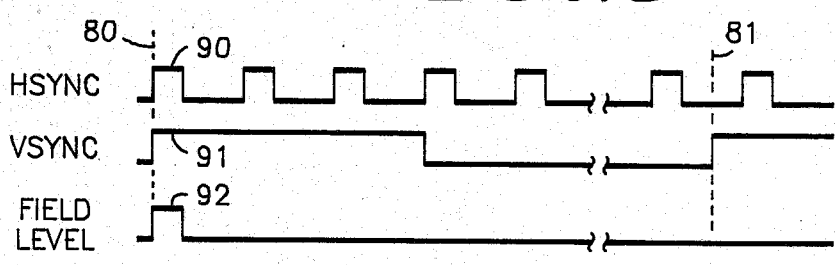

VIDEO FIELD DECODER

RELATED INVENTIONS

1. "Programmable Video Display Generator", invented by P. J. O'Malley, U.S. Ser. No. 551,812, filed 11/15/83.

2. "True Object Generation System and Method for a Video Display Generator", invented by W. F. Carleton, U.S. Ser. No. 551,814, filed 11/15/83.

3. "Horizontal Smooth Scrolling System and Method for a Video Display Generator", invented by L. A. Hopper, U.S. Ser. No. 551,809, filed 11/15/83.

4. "System and Method for Altering an Aspect of One of a Plurality of Coincident Visual Objects in a Video Display Generator", invented by W. M. Peterson, U.S. Ser. No. 551,815, filed 11/15/83, all of the above inventions having been assigned to the assignee of the present invention.

TECHNICAL FIELD

This invention relates generally to raster scan interlaced video display systems, and, in particular, to a circuit for determining whether the odd or even field is currently being displayed.

BACKGROUND OF THE INVENTION

The present invention concerns a portion of a video display system. The video display system may be of the type illustrated in the above-referenced inventions.

In such a video display system it is desired to have the ability to superimpose video graphics upon an external video source, such as a transmitted TV signal, cable TV signal, or video recorder signal. Such a video display system has utility, for example, in home computers, videotext systems, close-captioned TV systems, and arcade games. At present, such capability is known only for a non-interlaced external video signal, which in effect excludes normal NTSC or PAL external TV transmissions, since they are of the interlaced type.

In a non-interlaced system, the display information is simply repeated on corresponding lines of the two vertical sweeps or fields representing each frame. That is, line 0 of the even field repeats line 1 of the odd field. There is no difference in information between the even and odd fields. Thus in a video display system in which graphics are superimposed upon a non-interlaced external video signal, it is not necessary to know which field is currently being displayed. If the system is operating in the NTSC transmission system (but not receiving interlaced lines), this provides frame resolution of only 200 lines, or 250 lines in the PAL transmission system.

In order to provide greatly improved frame detail in a video display system in which graphics information is superimposed upon an external TV signal, it is desirable that the system be capable of working with the standard NTSC or PAL interlaced signals, in which the video information displayed during the even field is different than that displayed during the odd field. This in effect doubles the resolution of the information which can be displayed. In such a system it is necessary to know which field of the external video frame signal is currently being displayed.

BRIEF SUMMARY OF INVENTION

Accordingly, it is an object of the present invention to provide an improved video display system in which graphics information may be superimposed upon an external TV signal of the interlaced type.

It is also an object of the present invention to provide a video field decoder circuit for indicating which field of an interlaced video frame is currently being displayed.

These and other objects are achieved in accordance with a preferred embodiment of the invention by providing in a raster scan, interlaced video display system which displays a series of frames, each comprising a first field and a second field displayed successively, and including a video signal source comprising a horizontal sync signal and a field sync signal, the improvement comprising a video field decoding circuit comprising a comparator responsive to said horizontal sync signal and to said field sync signal for generating an output signal indicative of which field is currently being displayed.

BRIEF DESCRIPTION OF THE DRAWINGS

The invention is pointed out with particularity in the appended claims. However, other features of the invention will become more apparent and the invention will be best understood by referring to the following detailed description in conjunction with the accompanying drawings in which:

FIG. 1 shows a block diagram illustrating a portion of a video display system, including a preferred embodiment of the video field decoder of the present invention.

FIG. 2 shows various waveforms illustrating the operation of the video field decoder of the present invention.

DETAILED DESCRIPTION OF THE INVENTION

Referring now to FIG. 1, a block diagram of a portion of a video display system, including the video field decoder of the present invention is shown. The video display system has sophisticated video display capability and is useable with low cost microprocessor based systems. The video display system is more fully described in the above-referenced inventions, for example, in application Ser. No. 551,812. In the present description only the essential details of the video display system are shown.

The raster memory interface (RMI) unit 10 is a bipolar digital integrated circuit and represents the interface section of the video display system. The raster memory controller (RMC) unit 20 is a CMOS integrated circuit which provides the display address generation and processes the video data for the video display system.

The RMI 10 provides clock information to the raster memory controller (RMC) 20 over bus 15. The RMI 10 also provides a color subcarrier signal CSC over bus 19 to the video interface circuit 60. A master crystal oscillator 40 is also coupled to the RMI 10 via leads 11 and 12.

The RMC 20 has a SYNC terminal 5 which is programmable either as an input or an output terminal. According to the present invention, the SYNC terminal 5 is programmed as an input terminal which is responsive to the external field sync signal of the external video signal source received over lead 2. The RMC 20 generates an HSYNC signal internally, in a manner described in one or more of the above-identified inventions, which HSYNC signal is transmitted over internal lead 3 and external lead 8 to the phase-locked loop PLL 30, and over internal leads 3 and 4 to the comparator 50, respectively. The RMC 20 also generates R, G, and B output signals over leads 21-23, respectively, and a video enable (VIDEN) output signal over lead 24, to the video interface circuit 60. The video interface circuit 60 provides a video output signal on lead 56 which would typically be connected to a raster display (not shown).

In order to overlay graphics generated by the video display system with an external TV signal, it is necessary to synchronize the video output of the RMC 20 with the external TV signal source. The external video source is considered to be the master signal, and the RMC 20 output is the slave signal which changes its video timing to match the master timing. The vertical sync pulses of the RMC 20 are first matched to those of the external video signal by setting the RMC's SYNC input to be responsive to the external field sync signal, as mentioned above. The leading edge of this field sync signal should be a rising edge.

Next, the horizontal syncs of the two sources need to be matched. This is done by means of PLL 30, which compares the trailing edge of the external video's horizontal sync to the trailing edge of HSYNC. As mentioned above, HSYNC is generated within the RMC 20 and is used to maintain synchronization between the various clocks in the video display system. HSYNC occurs during each horizontal video line. The output of the PLL 30 is used to control the master oscillator 40. The PLL 30 circuit is able to change its frequency quickly enough to pull the horizontal sync pulses into sync quickly. For example, the frequency of the master oscillator can easily be changed by a minimum of 1500 Hz.

In order to determine whether the odd or even field of a given frame is being displayed, comparator 50 is provided. In a preferred embodiment comparator 50 is located within the RMC integrated circuit. Comparator 50 is responsive to the external field sync signal over internal lead 7 and to the HSYNC signal over internal leads 3, 4. When these signals are both high, comparator 50 generates a field level high signal, indicating, for example, that the even field is present. Comparator 50 may contain a suitable latch circuit (not shown) for latching up the coincidence states of the HSYNC and field sync (also referred to as VSYNC) signals until an appropriate time to be reset.

FIG. 2 shows the HSYNC signal 90, VSYNC (or field sync) signal 91, and field level signal 92. The rising edge of the VSYNC signal 91 coincides with the beginning of each vertical scan, representing the display of either an even field or an odd field.

Each rising edge of HSYNC signal 90 represents one horizontal scan. Between dotted line 80 and dotted line 81 there are actually 262.5 HSYNC signal pulses the 525-line NTSC system or 312.5 pulses in the 625-line PAL system.

When comparator 50 detects a coincidence in the rising edges of the HSYNC and VSYNC signals, as at the time indicated by dotted line 80, comparator 50 sets its field level signal output high, indicating the start of, for example, the even field. As mentioned above, the comparator 50 can contain suitable latching circuitry for latching the field level signal for a desired time period. It will be noted that at the next rising edge of the VSYNC signal, indicated at the time corresponding to dotted line 81, the HSYNC signal is low, so the field level signal remains at a low state.

It will be apparent to those skilled in the art that the disclosed video field decoder may be modified in numerous ways and may assume many embodiments other than the preferred form specifically set out and described above. For example, it will be understood that the expression "graphics" herein may refer to graphics, text, or anything generated by the video display system to be superimposed upon the external TV signal. Accordingly, it is intended by the appended claims to cover all modifications of the invention which fall within the true spirit and scope of the invention.

What is claimed is:

1. In a raster scan, interlaced video display system which displays a series of frames, each comprising a first field and a second field displayed successively, including a video signal source comprising a horizontal sync signal (1, FIG. 1) and a field sync signal (2, FIG. 1) and further including a synchronizing circuit for generating an internal horizontal sync signal which is synchronized with said horizontal sync signal, the improvements comprising:

a video field decoding circuit comprising a comparator (50, FIG. 1) responsive to a coincidence or non-coincidence between the respective rising edges of said internal horizontal sync signal and said field sync signal for generating an output signal indicative of which field is currently being displayed.

2. A raster scan, interlaced video display system for displaying a series of frames, each comprising a first field and a second field displayed successively, said display system comprising:

a video signal source comprising a horizontal sync signal (1 FIG. 1) and a field sync signal (2, FIG. 1);

a synchronizing circuit for generating an internal horizontal sync signal which is synchronized with said horizontal sync signal; and a video field decoding circuit comprising a comparator (50, FIG. 1) responsive to a coincidence or non-coincidence between the respective rising edges of said internal horizontal sync signal and said field sync signal for generating an output signal indicative of which field is currently being displayed.

* * * * *